US006469675B1

(12) United States Patent
Jo et al.

(10) Patent No.: US 6,469,675 B1
(45) Date of Patent: Oct. 22, 2002

(54) HIGH GAIN, FREQUENCY TUNABLE VARIABLE IMPEDANCE TRANSMISSION LINE LOADED ANTENNA WITH RADIATING AND TUNING WING

(75) Inventors: Young-Min Jo; Michael H. Thursby; Sean F. Sullivan, all of Palm Bay, FL (US)

(73) Assignee: ViaTech, Inc.

( * ) Notice: Subject to any disclaimer, the term of this patent is extended or adjusted under 35 U.S.C. 154(b) by 0 days.

(21) Appl. No.: 09/643,302

(22) Filed: Aug. 22, 2000

(51) Int. Cl.[7] ..... H01Q 11/14

(52) U.S. Cl. ..... 343/744; 343/741; 343/745; 343/866

(58) Field of Search ..... 343/728, 731, 343/741, 744, 745, 866

(56) References Cited

U.S. PATENT DOCUMENTS

| | | | | |
|---|---|---|---|---|
| 2,688,083 A | | 8/1954 | Hills | |
| 3,742,393 A | * | 6/1973 | Karp | 333/10 |
| 3,925,738 A | * | 12/1975 | Bates et al. | 333/31 R |
| 4,435,689 A | * | 3/1984 | McDowell | 333/81 A |
| 4,465,988 A | * | 8/1984 | Moats | 333/156 |
| 4,764,771 A | * | 8/1988 | Sterns | 342/373 |
| 5,061,944 A | | 10/1991 | Powers et al. | |
| 5,790,080 A | | 8/1998 | Apostolos | |
| 5,926,150 A | | 7/1999 | McLean et al. | |
| 6,025,811 A | | 2/2000 | Canora et al. | |
| 6,094,170 A | | 7/2000 | Peng | |

FOREIGN PATENT DOCUMENTS

| | | |
|---|---|---|
| EP | 0 691 738 A1 | 7/1995 |
| EP | 1 026 774 A2 | 1/2000 |

* cited by examiner

*Primary Examiner*—Don Wong
*Assistant Examiner*—Shih-Chao Chen
(74) *Attorney, Agent, or Firm*—John L. DeAngelis, Jr.; Beusse Brownlee Bowdoin & Wolter PA

(57) ABSTRACT

There is disclosed a meanderline loaded antenna comprising a ground plane, two vertical elements orthogonally affixed thereto, and a horizontal element between the two vertical elements. A meanderline coupler interconnects the horizontal element, at each of its ends, to the vertical elements. The antenna further includes an additional radiating element extending from the horizontal element in approximately planer relationship therewith. Additionally, the antenna includes a tuning element extending from the horizontal element and forming an acute angle with the adjacent vertical element.

15 Claims, 5 Drawing Sheets

HIGH GAIN, FREQUENCY TUNABLE VARIABLE IMPEDANCE TRANSMISSION LINE LOADED ANTENNA WITH RADIATING AND TUNING WING

BACKGROUND OF THE INVENTION

The present invention relates generally to antennas loaded by one or more meanderlines (also referred to as variable impedance transmission lines), and specifically to such an antenna providing high gain and frequency tunability through the use of wings affixed to the antenna structure.

It is generally known that antenna performance is dependent upon the antenna shape, the relationship between the antenna physical parameters (e.g., length for a linear antenna, diameter for a loop antenna) and the wavelength of the operating frequency. These relationships determine several antenna parameters, including input impedance, gain, and the radiation pattern shape. Generally, the minimum physical antenna dimension must be on the order of a quarter wavelength of the operating frequency, thereby allowing the antenna to be excited easily and to operate at or near its resonant frequency, which in turn limits the energy dissipated in resistive losses and maximizes the antenna gain.

The burgeoning growth of wireless communications devices and systems has created significant needs for physically smaller, less obtrusive, and more efficient antennas. As is known to those skilled in the art, there is an inherent paradox between the physical antenna size and the antenna gain, at least with respect to single-element antennas. Increased gain requires a physically larger antenna, while users continue to demand physically smaller antennas. As a further constraint, to simplify the system design and strive for minimum cost, equipment designers and system operators prefer to utilize antennas capable of efficient multi-frequency and wide bandwidth operation. Finally, it is known that the relationship between the antenna frequency and the antenna length (in wavelengths) determines the antenna gain. That is, the antenna gain is constant for all quarter wavelength antennas (i.e., at that frequency where the antenna length is a quarter of a wavelength).

One prior art technique that addresses certain of these antenna requirements is the so-called "Yagi-Uda" antenna, which has been successfully used for many years in applications such as the reception of television signals and in point-to-point communications. The Yagi-Uda antenna can be designed with high gain (or directivity) and a low voltage-standing-wave ratio (i.e., low losses) throughout a narrow band of contiguous frequencies. It is also possible to operate the Yagi-Uda antenna in more than one frequency band, provided that each band is relatively narrow and that the mean frequency of any one band is not a multiple of the mean frequency of another band.

Specifically, in the Yagi-Uda antenna, there is a single element driven from a source of electromagnetic radio frequency (RF) radiation. That driven element is typically a half-wave dipole antenna. In addition to the half-wave dipole element, the antenna has certain parasitic elements, including a reflector element on one side of the dipole and a plurality of director elements on the other side of the dipole. The director elements are usually disposed in spaced apart relationship in that portion of the antenna pointing in the transmitting direction or, in accordance with the antenna reciprocity theorem, in the receiving direction. The reflector element is disposed on the side of the dipole opposite from the array of director elements. Certain improvements in the Yagi-Udi antenna are set forth in U.S. Pat. No. 2,688,083 (disclosing a Yagi-Uda antenna configuration to achieve coverage of two relatively narrow non-contiguous frequency bands), and U.S. Pat. No. 5,061,944 (disclosing the use of a full or partial cylinder partly enveloping the dipole element).

U.S. Pat. No. 6,025,811 discloses an invention directed to a dipole array antenna having two dipole radiating elements. The first element is a driven dipole of a predetermined length and the second element is an unfed dipole of a different length, but closely spaced from the driven dipole and excited by near-field coupling. This antenna provides improved performance characteristics at higher microwave frequencies.

BRIEF SUMMARY OF THE INVENTION

The present invention discloses an antenna comprising one or more conductive elements, including a horizontal element and one or more vertical elements interconnected by meanderline couplers, and a ground plane. The meanderline has an effective electrical length that affects the electrical length and operating characteristics of the antenna. Further, the antenna conductive elements include one or more radiating wings conductively connected to the horizontal element and substantially parallel to the ground plane. The radiating wings increase the coupling between the ground plane and the horizontal element, improving the antenna gain. Further, the antenna can include one or more tuning wings forming an acute angle with one of the vertical elements to provide a frequency tuning capability for the antenna.

BRIEF DESCRIPTION OF THE DRAWINGS

The present invention can be more easily understood and the further advantages and uses thereof more readily apparent, when considered in view of the description of the preferred embodiments and the following figures in which.

DETAILED DESCRIPTION OF THE PREFERRED EMBODIMENTS

Figure 1:
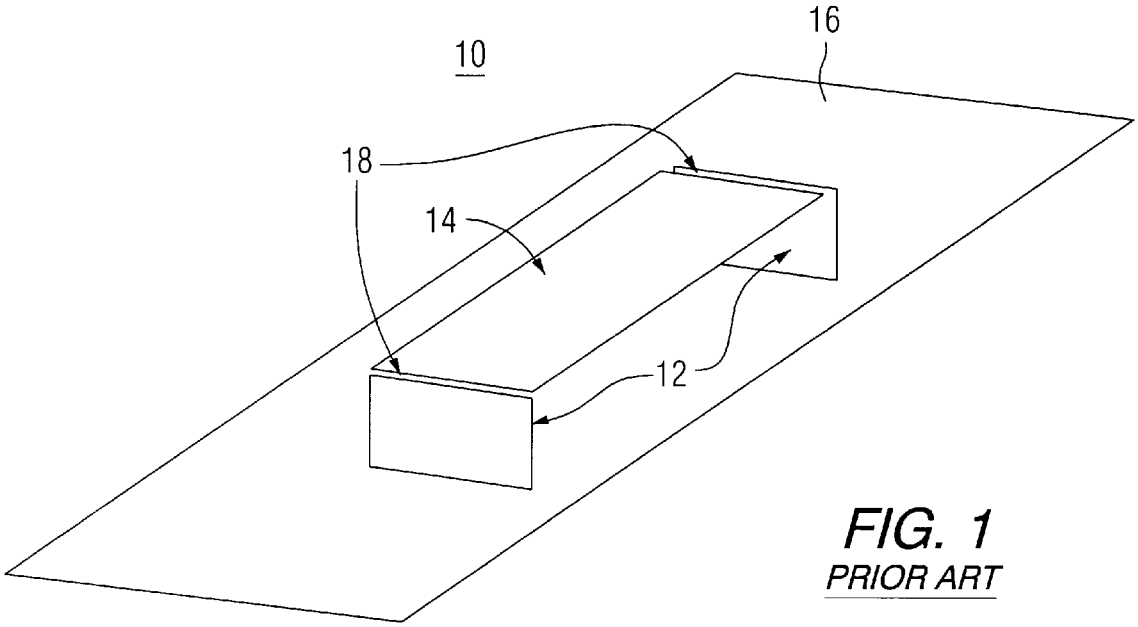
FIG. 1 PRIOR ART
FIG. 1 is a perspective view of a meanderline loaded antenna of the prior art.

Before describing in detail the particular meanderline loaded antenna constructed according to the teachings of the present invention, it should be observed that the present invention resides primarily in a novel and non-obvious combination of apparatus related to meanderline loaded antennas and antenna technology in general. Accordingly, the hardware components described herein have been represented by conventional elements in the drawings and in the specification description, showing only those specific details that are pertinent to the present invention, so as not to obscure the disclosure with structural details that will be readily apparent to those skilled in the art having the benefit of the description herein.

Figure 2:
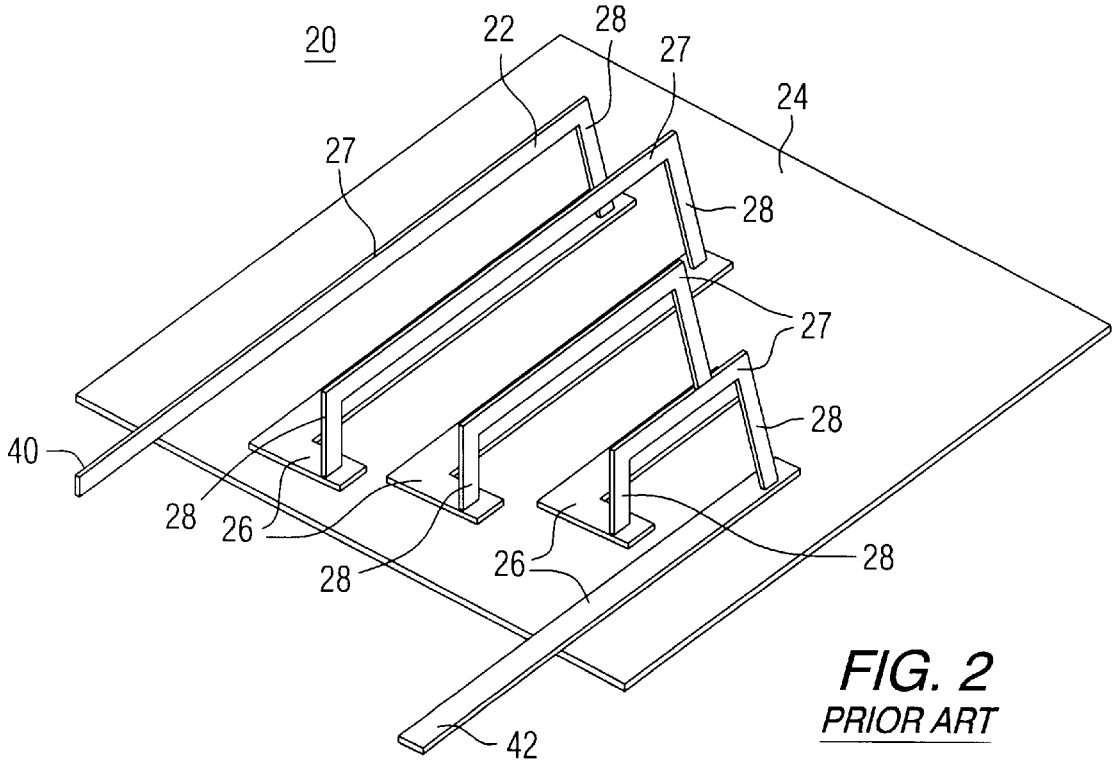
FIG. 2 PRIOR ART
FIG. 2 is a perspective view of a prior art meanderline conductor used as an element coupler in the meanderline loaded antenna of FIG. 1.

FIGS. 1 and 2 depict a prior art meanderline loaded antenna (See U.S. Pat. No. 5,790,080) to which the teachings of the present invention can be advantageously applied to increase the antenna gain and provide the antenna with frequency tunability, while maintaining an optimum input impedance characteristics. An example of a meanderline loaded antenna 10, also known as a variable impedance transmission line antenna, is shown in a perspective view in FIG. 1. Generally speaking, the meanderline loaded antenna 10 includes two vertical conductors 12, a horizontal conductor 14, and a ground plane 16. The vertical conductors 12 are physically separated from the horizontal conductor 14 by gaps 18. But the vertical conductors 12 are electrically interconnected to the horizontal conductor 14 by two meanderline couplers, one for each of the two gaps 18, to thereby form an antenna structure capable of radiating and receiving RF energy. The meanderline couplers electrically bridge the gaps 18 and are designed to adjust the electrical length of the meanderline loaded antenna 10. In addition, in one embodiment of the meanderline coupler, segments of the meanderline can be switched in or out of the circuit quickly and with negligible loss, to change the effective length of the meanderline couplers and therefore the electrical length of the meanderline loaded antenna 10. The antenna parameters can therefore be changed by changing the meanderline lengths. The active switching devices are located in high impedance sections of the meanderline, thereby minimizing the current through the switching devices and resulting in very low dissipation losses in the switch and thereby maintaining high antenna efficiency. The operational parameters of the meanderline loaded antenna 10 are substantially affected by the frequency of the input signal. According to the antenna reciprocity theorem, the antenna parameters are also substantially affected by the receiving signal frequency. Two of the various modes in which the antenna can operate are discussed herein below.

Although illustrated in FIG. 1 as having generally rectangular plates, it is known to those skilled in the art that the vertical conductors 12 and the horizontal conductor 14 can take on any of a variety of shapes. For instance, thin metallic conductors having a length significantly greater than a width, could be used as the vertical conductors 12 and the horizontal conductor 14. Single or multiple lengths of heavy gauge wire or conductive material in a filamental shape could also be used. Finally, it is known that the vertical conductors 12 and the horizontal conductor 14 do not necessarily require parallel opposing sides. For example, a conductive plate having sinuous or wavy edges can be used for the vertical conductors 12 and the horizontal conductor 14.

FIG. 2 shows a perspective view of a meanderline coupler 20 constructed for use in conjunction with the meanderline loaded antenna 10 of FIG. 1. Two meanderline couplers 20 are required for use with the meanderline loaded antenna 10. The meanderline coupler 20 is a slow wave meanderline in the form of a folded transmission line 22 mounted on a plate 24. The transmission line 22 is constructed from microstrip line including alternating sections 26 and 27. The sections 26 are mounted close to the plate 24; the sections 27 are spaced apart from the plate 24. This variation in height of the alternating sections 26 and 27 from the plate 24 gives the sections 26 and 27 different impedance values with respect to the plate 24. As shown in FIG. 2, each of the sections 27 is approximately the same distance above the plate 24. However, those skilled in the art recognize that this is not a requirement for the meanderline coupler 20. Instead, the various sections 27 can be located at differing distances above through the plat 24. Making this modification will change the characteristics of the coupler 20 from the uniform distances embodiment. Further, the characteristics of the antenna with which the coupler 20 is utilized will also be changed. Also, the impedance presented by the meanderline coupler 20 can be changed by changing the material or thickness of microstrip substrate or by changing the width of the sections 26, 27 or 28. In any case, the meanderline coupler 20 must present a controlled (but controllably variable if the embodiment so requires) impedance.

The sections 26, which are located relatively close to the plate 24 to create a lower characteristic impedance, are electrically insulated from the plate 24 by any suitable dielectric positioned therebetween. The sections 27 are located a controlled distance from the plate 24, wherein the distance determines the characteristic impedance of the section 27 in conjunction with the other physical characteristics of the folded transmission line 22, as well as the frequency of the signal carried by the folded transmission line 22.

The sections 26 and 27 are interconnected sections 28 mounted orthogonal to the plate 24. In this embodiment, the entire folded transmission line 22 may be constructed from a single continuous folded microstrip line.

Figure 3A:
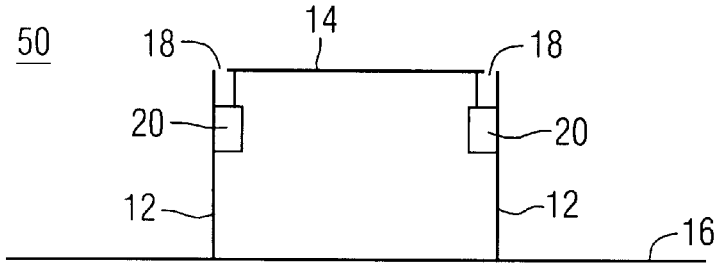
FIG. 3A PRIOR ART
FIGS. 3A through 3B illustrate two embodiments for placement of the meanderline couplers relative to the antenna elements.
Figure 3B:
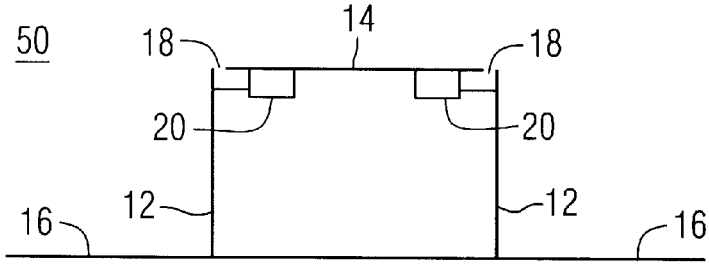
FIG. 3B PRIOR ART

The meanderline coupler 20 includes terminating points 40 and 42 for interconnecting to the elements of the loop antenna 10. Specifically, FIG. 3A illustrates two meanderline couplers 20, one affixed to each of the vertical conductors 12 such that the vertical conductor 12 serves as the plate 24, so as to form a meanderline loaded antenna 50. One of the terminating points, for instance the terminating point 40, is connected to the horizontal conductor 14 and the terminating point 42 is connected to the vertical conductor 12. The second of the two meanderline couplers 20 illustrated in FIG. 3A is configured in a similar manner. FIG. 3B shows the meanderline couplers 20 affixed to the horizontal conductor 14, such that the horizontal conductor 14 serves as the plate 24 of FIG. 2. As in FIG. 3A, the terminating points 40 and 42 are connected to the vertical conductors 12 and the horizontal conductor 14 so as to interconnect the vertical conductors 12 and the horizontal conductor 14 across the gaps 18.

Figure 4:
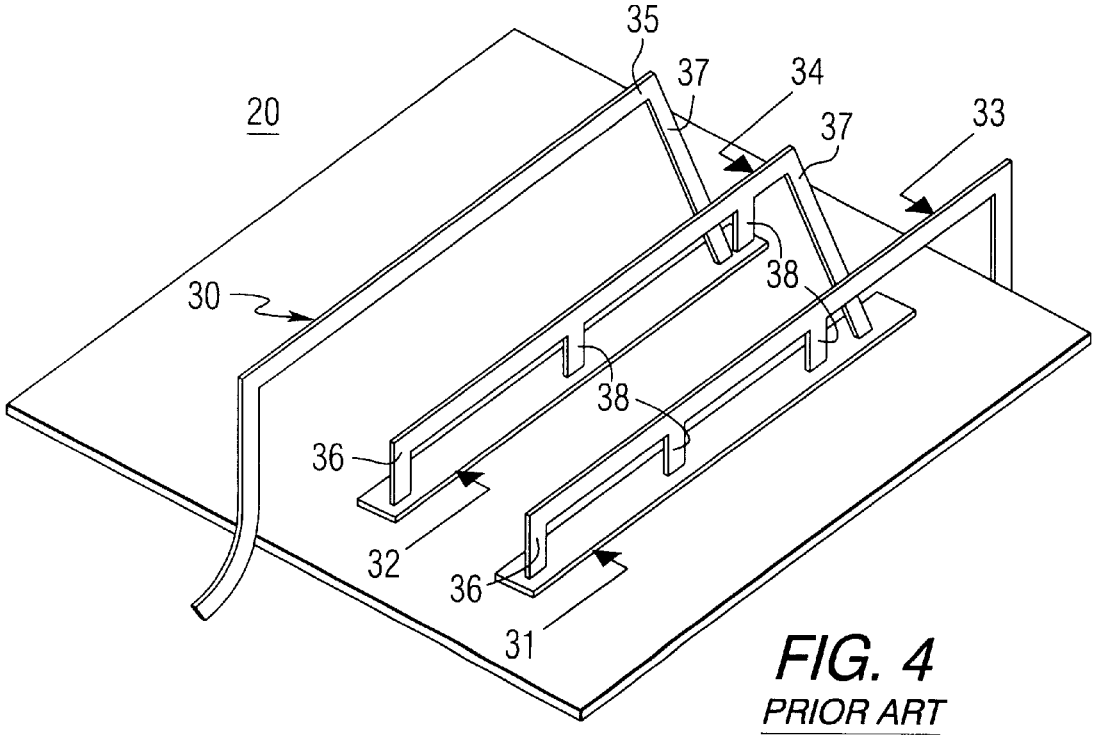
FIG. 4 PRIOR ART
FIG. 4 shows another embodiment of a meanderline coupler.

FIG. 4 is a representational view of a second embodiment of the meanderline coupler 20, including low impedance sections 31 and 32 and relatively higher impedance sections 33, 34, and 35. The low impedance sections 31 and 32 are located in a parallel spaced apart relationship to the higher impedance sections 33 and 34. The sequential low impedance sections 31 and 32 and the higher impedance sections 33, 34, and 35 are connected by substantially orthogonal sections 36 and by diagonal sections 37. The FIG. 4 embodiment includes shorting switches 38 connected between the adjacent low and higher impedance sections 32/34 and 31/33. The shorting switches 38 provide for electronically switchable control of the lengths of the meanderline coupler 20. As discussed above, the length of the meanderline coupler 20 has a direct impact on the center frequency of the meanderline loaded antenna 50 to which the meanderline couplers 20 are attached, as shown in FIGS. 3A and 3B. As is well known in the art, there are several alternatives for implementing the shorting switches 38, including mechanical switches or electronically controllable switches such as pin diodes. In the embodiment of FIG. 4, all of the low impedance sections 31 and 32 and the higher impedance sections 33, 34, and 35 are of approximately equal length.

Figure 5:
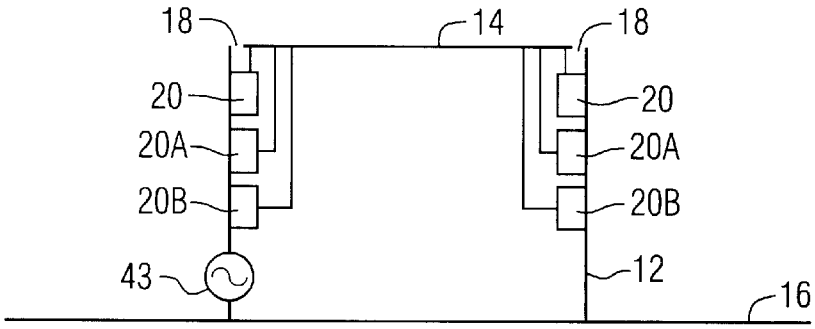
FIG. 5 PRIOR ART
FIG. 5 is an embodiment of the present invention illustrating the availability of a plurality of meanderline couplers.

The operating mode of the meanderline loaded antenna 50 depends upon the operating frequency and the electrical length of the entire antenna, including the meanderline coupler 20. Thus the meanderline loaded antenna 50, like all antennas, has a specific electrical length, which will cause it to operate in a mode determined by the signal operating frequency. That is, different operating frequencies excite the antenna to operate in different modes and therefore produce different antenna radiation patterns. For example, the antenna may exhibit the characteristics of a monopole at a first frequency, but exhibit the characteristics of a loop antenna at a second frequency. Further, the length of the meanderline coupler 20 can be changed (as discussed above) to effect the antenna electrical length and in this way change the operational mode at a given frequency. Still further, a plurality of meanderline couplers 20 of differing lengths can be connected between the horizontal conductor 14 and the vertical conductors 12. Depending upon the desired antenna operating mode, two matching meanderline couplers 20 can be selected to interconnect the horizontal conductor 14 and the vertical conductors 12. Such an embodiment is illustrated in FIG. 5 including matching meanderline couplers 20, 20A and 20B. A controller (not shown in FIG. 5) is connected to the meanderline couplers 20, 20A and 20B for selecting the operative coupler. A well-known switching arrangement can activate the selected meanderline coupler to connect the horizontal conductor 14 and the vertical conductors 12, dependent upon the desired antenna characteristics.

Figure 6:
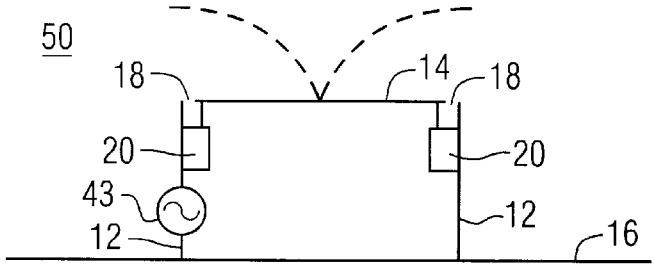
FIG. 6 PRIOR ART
FIGS. 6 through 9 illustrate exemplary operational modes for a meanderline loaded antenna.
Figure 7:
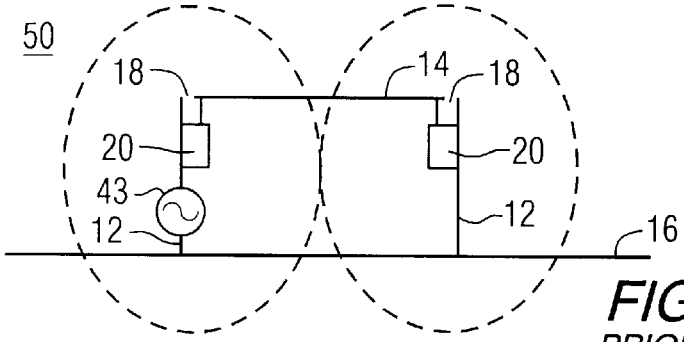
FIG. 7 PRIOR ART

Turning to FIGS. 6 and 7, there is shown the current distribution (FIG. 6) and the antenna electric field radiation pattern (FIG. 7) for the meanderline loaded loop antenna 50 operating in a monopole or half wavelength mode and driven by a source 40. That is, in this mode, at a frequency of between approximately 800 and 900 MHz and further given a specific length for the meanderline couplers 20, the horizontal conductor 14 and the vertical conductors 12, the horizontal conductor 14 has a current null near the center and current maxima at each edge. As a result, a substantial amount of radiation is emitted from the vertical conductors 12, and little radiation is emitted from the horizontal conductor 14. As a result, the field pattern has the familiar omnidirectional donut shape as shown in FIG. 7.

Those skilled in the art will realize that a frequency of between 800 and 900 MHz is merely exemplary. The antenna characteristics will change when excited by other frequency signals and the various antenna components (the meanderline couplers 20, the horizontal conductor 14 and the vertical conductors 12) can be modified to create an antenna having monopole-like characteristics at other frequencies. A meanderline loaded antenna such as that shown in FIGS. 3A and 3B will exhibit monopole-like characteristics at a first frequency and loop-like characteristics at second frequency, where there is a loose relationship to the two frequencies. Similar characteristics (i.e., monopole and loop characteristics) can be achieved at any other two loosely related frequencies by changing the antenna design.

Figure 8:
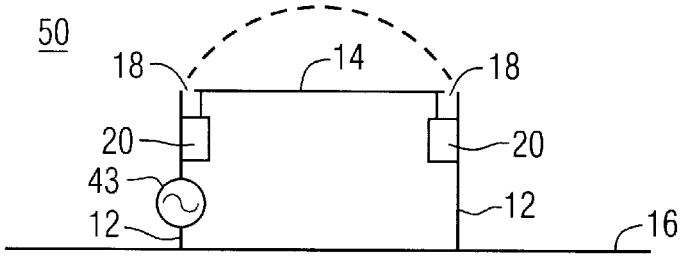
FIG. 8 PRIOR ART
Figure 9:
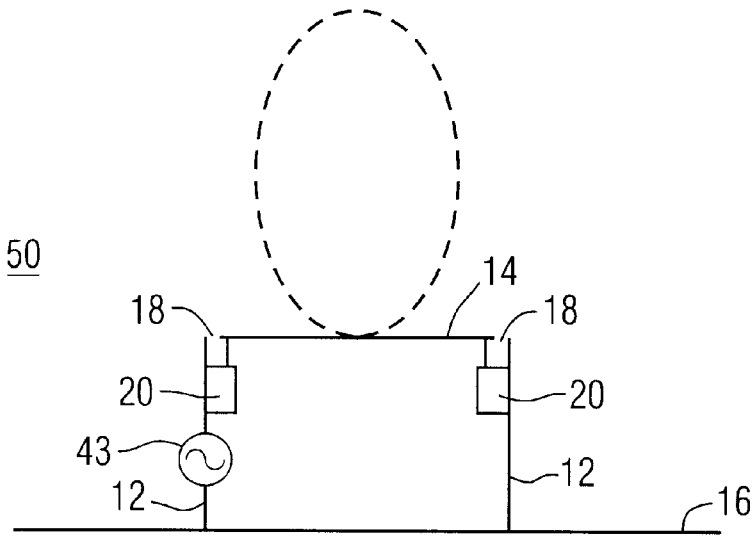
FIG. 9 PRIOR ART

A second exemplary operational mode for the meanderline loaded antenna 50 is illustrated in FIGS. 8 and 9. This mode is the so-called loop mode. Note in this mode the current maxima occurs approximately at the center of the horizontal conductor 14 (see FIG. 8) resulting in an electric field radiation pattern as illustrated in FIG. 9. Note that the antenna characteristics displayed in FIGS. 8 and 9 are based on an antenna of the same electrical length (including the length of the meanderline couplers 20) as the antenna parameters depicted in FIGS. 6 and 7. Thus, at a frequency of approximately 800 to 900 MHz, the antenna displays the characteristics of FIGS. 6 and 7. For a signal frequency of approximately 1.5 GHz, the same antenna displays the characteristics of FIGS. 8 and 9. By changing the antenna design, monopole and loop characteristics can be attained at two other loosely related frequencies.

Although the meanderline loaded loop antenna 50 offers certain advantages as discussed above, including its small physical size, it does not provide sufficient gain in certain applications. Of course, it is known to form an array of single elements to increase antenna gain, but this disadvantageously increases the physical size of the antenna. Additional gain can also be realized by increasing the size of the ground plane 16, but this too increases the physical size. Further, in certain applications, the meanderline loaded antenna 50 is required to have more than a single frequency of operation. Given this preference, it is known that matching the impedance of the antenna to the transmission line at more than one frequency can be problematic.

Figure 10:
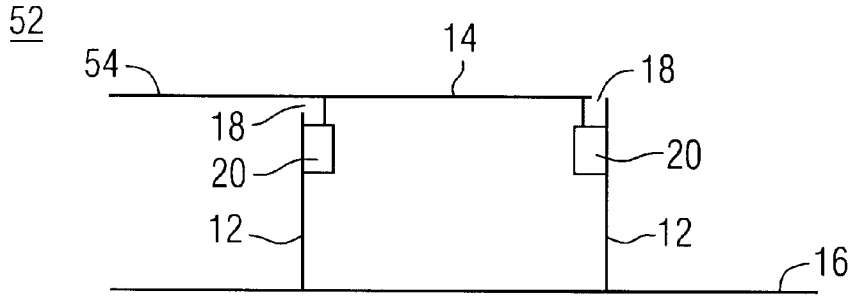
FIGS. 10 through 14 illustrate embodiments of meanderline loaded antennas constructed according to the teachings of the present invention.

An antenna 52 constructed according to the teachings of the present invention is shown in FIG. 10, with the addition of a radiating wing 54 connected to the horizontal conductor 14, as shown. As will be appreciated by those skilled in the art, in lieu of attaching a separately constructed radiating wing 54 to the horizontal conductor 14, the radiating wing 54 can be created by simply extending the length of the horizontal conductor 14. The radiating wing 54 significantly improves the gain of the antenna 52 when the antenna 52 is operating in the mode where the horizontal conductor 14 is the radiating element, i.e., the loop mode as discussed above. In one embodiment, the radiating wing is 0.8 inches in length, however, the length can be increased or decreased to optimize the gain in accord with the performance requirements and the operational frequency of the antenna 52. For comparison purposes, in the embodiment where the radiating wing is 0.8 inches long, the horizontal conductor 14 is 0.7 inches in length. Thus, the total length of the horizontal radiating element is 1.5 inches. At higher operational frequencies, the radiating wing 52 length obviously can be made shorter to provide the same effective coupling and gain increase. The optimal length for the radiating wing 52 is also dependent upon the distance between the radiating wing 52 and the ground plane 16, as the radiating wing provides additional coupling to the ground plane 16. In one embodiment, the gain increased several dB with the addition of a 0.8 inch radiating wing 54.

Figure 11:
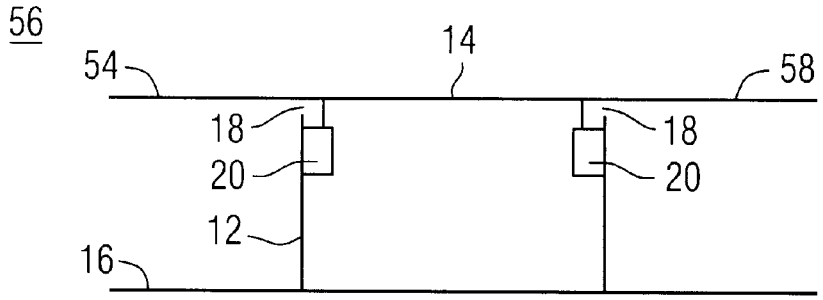

FIG. 11 illustrates another embodiment showing an antenna 56, including the radiating wing 54 and a second radiating wing 58. The radiating wing 58 functions in a manner similar to the radiating wing 54 by adding coupling to the ground plane 16 and thereby gain to the antenna 56 when operating in the loop mode. It should also be observed that adding the radiating wings 54 and/or 58 does not have a substantial effect on the impedance characteristics of the antenna 56 with respect to the feeding transmission line.

Figure 12:
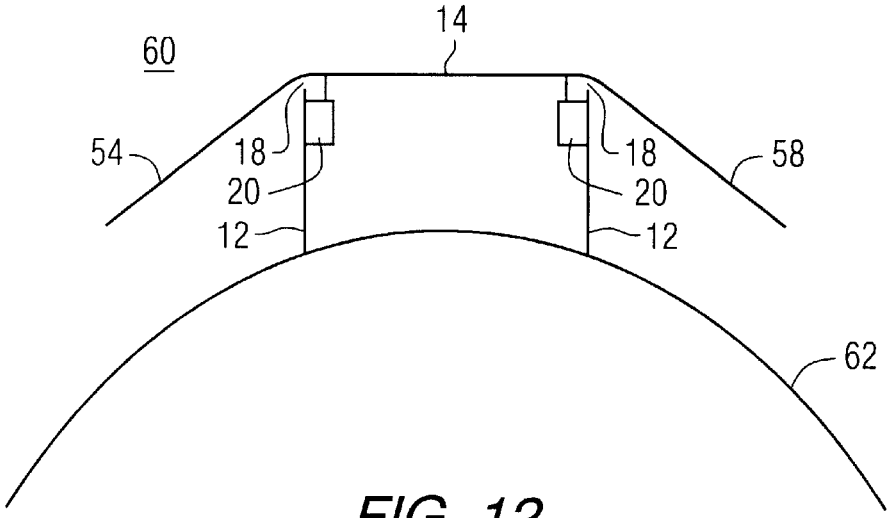

In yet another embodiment illustrated in FIG. 12, an antenna 60 constructed according to the teachings of the present invention is affixed to a curved ground plane 62. In this embodiment, the radiating wings 54 and 58 are bent so as to approximately follow the curvature of the ground plane 62 and thereby increase the coupling between the ground plane 62 and the radiating wings 54 and 58. Although the radiating wings 54 and 58 are shown as linear elements in FIG. 12, both can in fact be bent to more closely follow the shape of the curved ground plane 62. Generally, sufficient coupling between the curved ground plane 62 and the radiating wings 54 and 58 is created when the radiating wings 54 and 58 are linear, however, in certain applications, additional gain may be required and thus bending the radiating wings 54 and 58 to the same curvature as the curved ground plane 62 may be beneficial. The bending of the radiating wings 54 and 58 can also be used to achieve a change in the characteristic impedance of the antenna 60. For instance, assume an antenna 60 constructed according to the teachings of the present invention in free space has a characteristic impedance of 50 ohms. When the antenna is affixed to a ground plane, such as the ground plane 62, the characteristic impedance will no longer be 50 ohms. However, according to the teachings of the present invention, the radiating wings 54 and 58 can be bent to provide a characteristic impedance of 50 ohms at the desired frequency.

Figure 13:
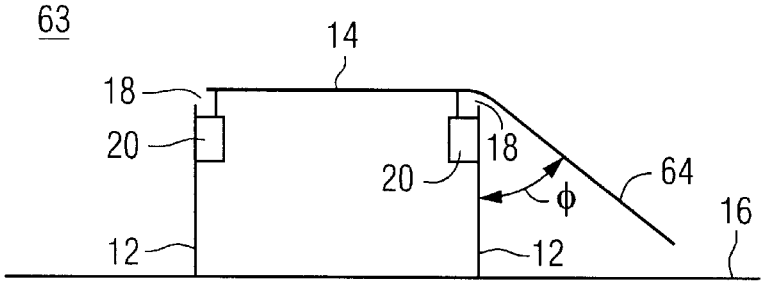

Another embodiment of an antenna 63 constructed according to the teachings of the present invention is illustrated in FIG. 13. The FIG. 13 embodiment includes a tuning wing 64 attached to the horizontal conductor 14 and forming an angle Ø with the adjacent vertical conductor 12. In the monopole mode, there is significantly greater current flowing in the vertical conductors 12 than in the horizontal conductor 14. Therefore, there is considerably greater coupling between the vertical conductor 12 and the tuning wing 64 so that the operational frequency in the monopole mode can be adjusted by changing the angle Ø. Tuning of both the monopole and loop mode frequencies is accomplished by adjusting the length of the radiating wings 54 and/or 58. Then the monopole mode frequency can be further independently tuned by adjusting the angle Ø.

Note further that the tuning wing 64 of FIG. 13 has some effect on the antenna gain in the loop mode because there is some coupling between the tuning wing 64 and the ground plane 16. However, the degree of coupling is minimal compared to the coupling provided by a horizontal radiating wing, such as the radiating wings 54 and 58 of FIG. 11. Finally, although the tuning wing 64 is illustrated on the right-hand side of the antenna 62, those skilled in the art will recognize that in another embodiment the tuning wing 64 could be located on the left-hand side with substantially identical effects. Further, two tuning wings, one on each side of the horizontal conductor 14, can be employed as required to provide additional tuning capability.

Figure 14:
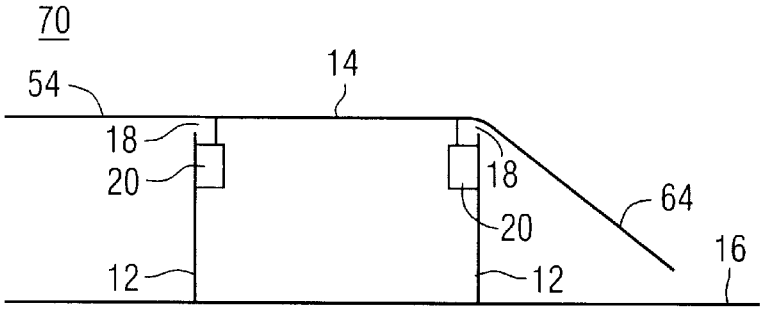

Turning to FIG. 14, there is shown both the radiating wing 54 and the tuning wing 64, which are two elements of an antenna 70, constructed according to the teachings of the present invention. As discussed above, the radiating wing 54 substantially impacts the antenna gain in the loop mode, as well as the center frequency for that mode. The tuning wing 64 most directly effects the center frequency of the monopole mode, while having little effect on the gain in either mode. Thus, in operation, the length of the radiating wing 54 is established based on the operating frequency and gain characteristics desired. Then the tuning wing 64 is added and bent downwardly to establish the operating frequency in the monopole mode, without having significant effect on the loop mode operating frequency.

Figure 15:
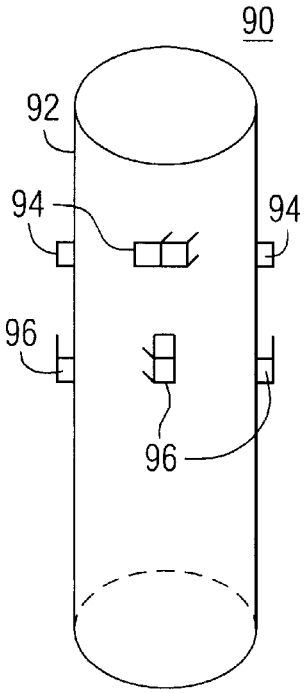
FIG. 15 illustrates an antenna array constructed with the meanderline loaded antennas of the present invention.

FIG. 15 depicts an exemplary embodiment wherein a plurality of meanderline loaded antennas 94 constructed according to the teachings of the present invention are used in an antenna array 90. Depending upon the performance characteristics desired, the meanderline antenna 94 can comprise any of the embodiments illustrated in FIGS. 10, 11, 13, and 14. The meanderline antenna 94 are fixedly attached to a cylinder 92 that serves as a ground plane 16 and provides a signal path to the meanderline antennas 94. Advantageously, the meanderline antennas 94 in an upper area are oriented so as to produce a horizontally polarized signal, while the meanderline antennas in the lower area are disposed to emit a vertically polarized signal. Although only two rows of the meanderline antennas 94 are illustrated in FIG. 15, those skilled in the art will recognize that additional parallel rows can be included in the antenna array 90 so as to provide additive gain. A gain of the antenna array 90 comprises both the element factor and the array factor, as is well known in the art. Although not illustrated in FIG. 15, the FIG. 12 embodiment can be applied to the antenna array 90, where the cylinder 92 serves as the ground plane 62 of FIG. 12. The tuning wing embodiment of FIG. 13 can also be used in the antenna array 90.

While the invention has been described with reference to preferred embodiments, it will be understood by those skilled in the art that various changes may be made and equivalent elements may be substituted for elements thereof without departing from the scope of the present invention. In addition, modifications may be made to adapt a particular situation more material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An antenna comprising:

a conductive plate;

first and second conductive elements connected to said conductive plate in an opposing substantially parallel spaced apart orientation with respect to each other and projecting away from said conductive plate;

a third conductive element bridging the space between said first and said second conductive elements and projecting beyond said first conductive element, wherein said third conductive element is spaced away from said first and said second conductive elements so as to form a gap between said first and said third conductive elements and so as to form a gap between said second and said third conductive elements, and wherein said third conductive element is spaced apart from said conductive plate;

a first meanderline serially connected between said first and said third conductive elements so as to provide an electrical path across the gap therebetween;

a second meanderline serially connected between said second and said third conductive elements so as to create an electrical path across the gap therebetween; and wherein said first and said second meanderlines have an effective electrical length that affects the electrical length and operating characteristics of the antenna.

2. The antenna of claim 1 wherein the third conductive element is substantially parallel to the conductive plate.

3. The antenna of claim 1 wherein the conductive plate is substantially flat and the third conductive element is parallel thereto.

4. The antenna of claim 1 wherein the third conductive element is bent toward the conductive plate over that portion of the third conductive element projecting beyond the first conductive element.

5. The antenna of claim 1 wherein the distance between the conductive plate and the third conductive element is chosen to achieve certain antenna characteristics.

6. The antenna of claim 1 wherein the third conductive element includes first and second opposing substantially parallel edges, and wherein said first edge projects beyond the first conductive element and wherein said second edge projects beyond the second conductive element.

7. The antenna of claim 1 wherein the third conductive element forms an acute angle with the first conductive element so as to effect certain impedance characteristics of the antenna.

8. The antenna of claim 1 further comprising:

a third meanderline serially connected between the first and the third conductive elements in parallel with the first meanderline;

a fourth meanderline serially connected between the second and the third conductive elements in parallel with the second meanderline;

wherein the first and the second meanderlines have substantially identical electrical characteristics and wherein said third and said fourth meanderlines have substantially identical electrical characteristics differing from the electrical characteristics of the first and second meanderlines;

a controller for selecting either the first and the second meanderlines or for selecting said third and said fourth meanderlines, wherein the selected pair of meanderlines become active elements of the antenna.

9. The antenna of claim 1 wherein the first and the second conductive elements are orthogonally connected to the conductive plate.

10. An antenna comprising:

a conductive plate;

first and second conductive elements connected to said conductive plate in an opposing substantially parallel spaced apart orientation with respect to each other and projecting away from said conductive plate, wherein said first and said second conductive elements are subsumed within a first and a second plane respectively;

a third conductive element bridging the space between said first and said second conductive elements and projecting beyond said first plane and said second planes, wherein said third conductive element is, spaced away from said first and said second conductive elements so as to create a gap between said first and said third conductive elements and so as to create a gap between said second and said third conductive elements, and wherein said third conductive element is spaced away from said conductive plate;

a first meanderline serially connected between said first and said third conductive elements so as to provide an electrical path across the gap therebetween; and a second meanderline serially connected between said second and said third conductive elements so as to provide an electrical path across the gap therebetween.

11. The antenna of claim 10 wherein that portion of the third conductive element extending beyond the plane including the first conductive element is substantially parallel to the conductive plate, and wherein that portion of the third conductive element extending beyond the plane including the second conductive element forms an acute angle with the second conductive element.

12. An antenna array comprising:

a ground plane;

a plurality of antenna elements connected to said ground plane, wherein each antenna element comprises:

A. first and second conductive elements orthogonally connected to the ground plane in an opposing substantially parallel spaced apart orientation with respect to each other and projecting away from said ground plane;

B. a third conductive element bridging the space between said first and said second conductive elements and projecting beyond said first conductive element, wherein said third conductive element is spaced away from said first conductive element so as to create a gap therebetween, and wherein said third conductive element is spaced away from said second conductive element so as to create a gap therebetween, and wherein said third conductive element is spaced apart from said ground plane;

C. a first meanderline serially connected between said first and said third conductive elements so as to provide an electrical path across the gap therebetween;

D. a second meanderline serially connected between said second and said third conductive elements so as to create an electrical path across the gap therebetween; and wherein a first number of said plurality of antenna elements are oriented such that the portion of said third conductive element extending beyond the plane including said first conductive element is oriented vertically thereby providing vertical polarization, and wherein a second number of said plurality of antenna elements are oriented such that a portion of said third conductive element extending beyond the plane including said first conductive element is oriented horizontally, thereby providing horizontal polarization.

13. The antenna array of claim 12 wherein the ground plane is cylindrically shaped, and wherein the first number of the plurality of the antenna elements are spaced circumferentially around the ground plane at a first axial location, and wherein the second number of the plurality of antenna elements are spaced circumferentially around the ground place at a second axial location.

14. The antenna array of claim 13 wherein the first number of the plurality of antenna element includes four antenna elements spaced circumferentially at 90 degrees apart.

15. The antenna array of claim 13 wherein the second number of the plurality of antenna elements includes four antenna elements spaced circumferentially at 90 degrees apart.

* * * * *